US006149114A

United States Patent [19]

Epping et al.

[11] Patent Number: 6,149,114

[45] Date of Patent: Nov. 21, 2000

[54] MOUNTING DEVICE FOR ATTACHING A MICROPHONE TO A MUSICAL INSTRUMENT

[75] Inventors: Heinz Epping, Neustadt; Gerd Söhnholz, Essel, both of Germany

[73] Assignee: Sennheiser electronic GmbH & Co. KG, Wedemark, Germany

[21] Appl. No.: 09/243,050

[22] Filed: Feb. 3, 1999

[30] Foreign Application Priority Data

Feb. 4, 1998 [DE] Germany ..... 198 04 315

[51] Int. Cl.[7] ..... A47B 96/06

[52] U.S. Cl. ..... 248/220.22; 248/231.51; 84/723

[58] Field of Search ..... 248/229.16, 229.26, 248/220.22, 231.81, 231.51, 221.11; 84/723

[56] References Cited

U.S. PATENT DOCUMENTS

| | | | |
|---|---|---|---|
| 344,567 | 6/1886 | Kosmoski et al. | 248/229.16 |
| 3,883,926 | 5/1975 | Reynolds | 24/73 CP |
| 5,354,026 | 10/1994 | Bulla | 248/229 |
| 5,371,991 | 12/1994 | Bechtel | 52/686 |
| 5,947,434 | 6/1886 | Kosmoski et al. | 248/298.1 |

FOREIGN PATENT DOCUMENTS

| | | |
|---|---|---|
| 295 18 362 U | 1/1995 | Germany . |
| 296 14 188 U | 8/1996 | Germany . |

*Primary Examiner*—Ramon O. Ramirez
*Assistant Examiner*—Walter Landry
*Attorney, Agent, or Firm*—Merchant & Gould P.C.

[57] ABSTRACT

The invention proposes a mounting device for attaching a microphone or a microphone inset to a musical instrument, comprising two clamping sections between which a section of a musical instrument can be gripped by spring force, a connecting section, which both clamping sections are connected to resiliently by one of their ends, a holding mechanism to attach a microphone or a microphone inset to the mounting device, and one actuator section on each of the clamping sections whereby, in the unutilized position of mounting device, the actuator section on one of the two clamping sections at least partially overlaps the other clamping section, in the direction of the spring force generated by this clamping section when gripping a section of a musical instrument. One of the clamping sections is executed at least in two parts, and the component sections originate, separated laterally from each other, from the connecting section and the other clamping section is located at least partially between the component sections.

18 Claims, 2 Drawing Sheets

MOUNTING DEVICE FOR ATTACHING A MICROPHONE TO A MUSICAL INSTRUMENT

FIELD OF THE INVENTION

The invention relates to a mounting device for attaching a microphone or a microphone inset to a musical instrument.

BACKGROUND OF THE INVENTION

Mounting devices are known, by which a microphone can be attached to a musical instrument, in particular to the bell of a wind instrument. Commonly used mounting devices of this type possess a complicated design of several components. In addition, as a rule, the geometrical dimensions of mounting devices are disproportionately large compared to microphones, which are getting smaller due to progress in miniaturization.

SUMMARY OF THE INVENTION

The objective of the present invention is to build upon a mounting device of the type mentioned above to obtain a simple and compact design.

The invention meets the objective for a mounting device of the above mentioned type by comprising two clamping sections, between which a section of the musical instrument can be gripped by spring force, one connecting section, that both clamping sections are resiliently connected to by one of their ends, one holding mechanism to attach the microphone or microphone inset to the mounting device, and one actuator section on each of the clamping sections. Hereby, in the unused position of mounting device, the actuator section, on one of the two clamping sections at least partially overlaps the other clamping section in the direction of the spring force generated by this clamping section when gripping a section of the musical instrument. In addition, at least one of the clamping sections is formed in at least two parts, the component sections extend, laterally separated from each other, from the connecting section, and the other clamping section is located at least partially between the component sections.

The advantage of the invention in particular lies in the fact that an extremely compact and at the same time uncomplicated design is achieved by the actuator sections provided on the clamping sections. In addition, the mounting device is easily handled by opening it through pressing together the actuator sections. This invention's mounting device can thus be safely attached to, or detached from, a musical instrument, without scratching a location of the musical instrument, or otherwise damaging it. To a certain degree, each component section is free to move independently of the other component sections of the clamping section, due to the multi-part design of the clamping sections. Thus, the mounting device is in contact with a musical instrument at several positions even when encountering curved contact surfaces. As a result, the mounting device provides a secure support for different musical instruments, in particular when dealing with the varying curvature radii of bells of wind instruments.

In a practical further development of the mounting device, the component sections of a clamping section essentially extend in parallel and separated from each other by some distance.

In a preferred embodiment of the mounting device, the actuator sections are located in proximity to the connecting section. As a result, the section of the musical instrument to which the mounting device is attached, reaches as far back as possible between the clamping sections. This safeguards a secure support of the mounting device and thus of the microphone, even if the musical instrument is, e.g., moved rapidly.

To facilitate easier handling, an actuator section is provided on each component section of the multi-part clamping sections.

In a preferred embodiment, the mounting device is formed as a single piece, and preferably consists mostly of an elastic material. This adds to the simplification of the design of the mounting device, reducing the manufacturing expense.

Preferably, the first clamping section of the invention's mounting device is formed in two parts. The component sections extend from the connecting section essentially in parallel and separated from each other. The second clamping section is executed as one piece and is essentially located between the component sections of the first clamping section. In a practical further development, the free ends of the component sections of the two-part clamping section are joined, and the other clamping section is short compared to the component sections, so that it is located between the component sections. This design of the mounting device makes possible the manufacturing of the mounting device, with the clamping sections in a closed position, as one piece, e.g. by casting and/or stamping. The mounting device can be opened by pressing together the complementary actuator sections against the spring tension, which is determined by the material's elasticity. The restoring force of the clamping sections can be controlled to a high degree by a suitable design of the clamping sections.

In a preferred embodiment of the mounting device, the nonattached ends of the clamping sections are curved by an assigned amount, against the direction of the spring force created by the corresponding clamping sections when gripping a section of a musical instrument. This is to facilitate the attaching of the mounting device to a musical instrument. Hereby, the outward curved ends of the clamping sections essentially serve as guide sections.

In another embodiment, to avoid a possible slipping of the mounting device off the musical instrument, stop lugs are provided on the mounting device on that side of the clamping sections which faces the section of the musical instrument being gripped between the clamping sections. The stop lugs extend from the clamping sections in the direction of the spring force as defined by the restoring force of the clamping sections. In the attached position, these stop lugs reach behind, for example, the raised beading at the bell's rim of a brass wind instrument.

Favorable further developments of the invention are characterized by the features listed in the secondary claims.

DRAWINGS

In the following, the invention is exemplified by figures.

DETAILED DESCRIPTION

Figure 1:
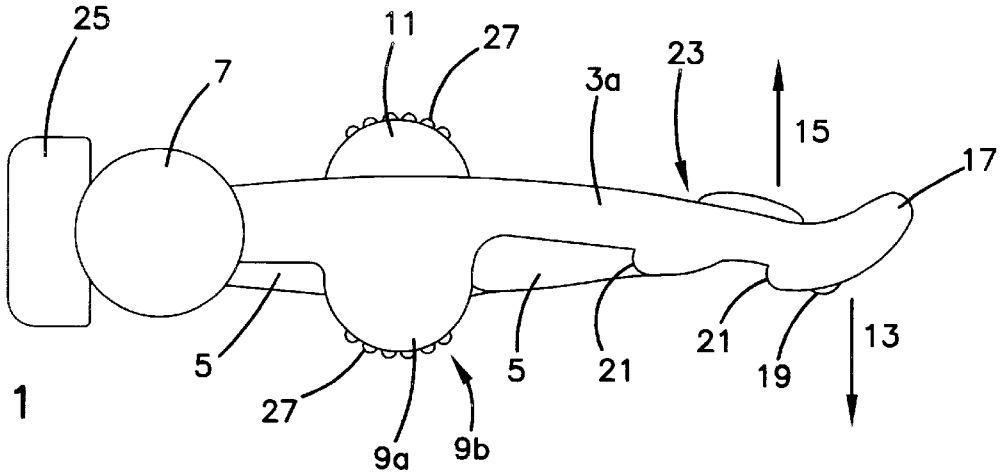
FIG. 1 is a side view of this invention's mounting device.
Figure 2:
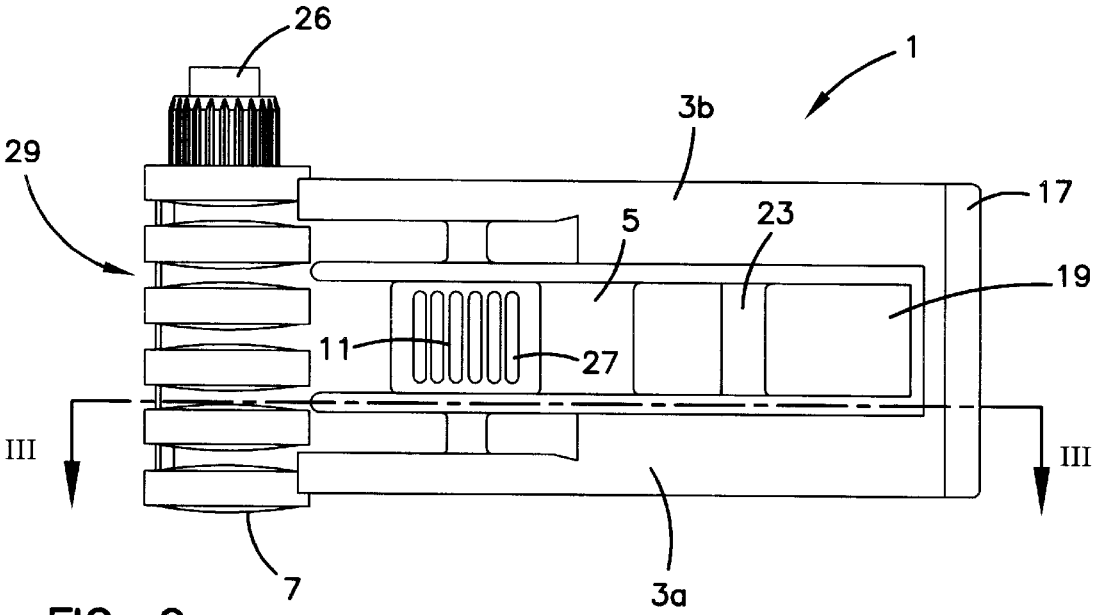
FIG. 2 is a front view of the mounting device of FIG. 1 without the holding mechanism.
Figure 3:
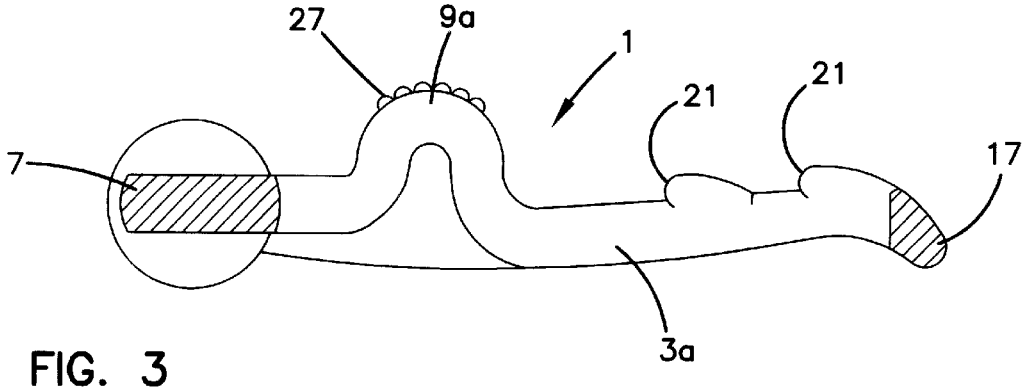
FIG. 3 is a sectional view of the mounting device along the section III—III of FIG. 2.
Figure 4:
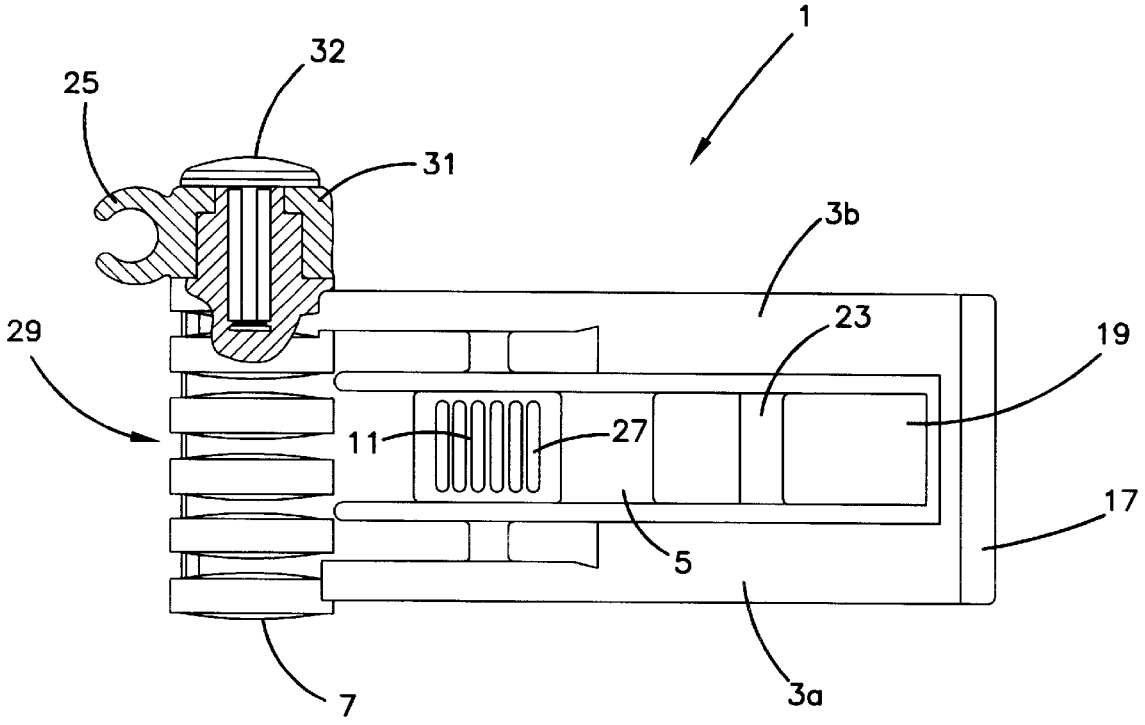
FIG. 4 is a front view of the mounting device of FIG. 1 with a local section in the area of the holding mechanism.

The mounting device 1, illustrated in FIGS. 1 to 4, for attaching a microphone to a musical instrument, in particular to the bell of a wind instrument, comprises two clamping sections 3 and 5, essentially bar- or beam- shaped, a connecting section 7, which both clamping sections 3 and 5 are resiliently connected to at one of their ends, and a holding mechanism 25 (not shown in FIGS. 2 and 3), to attach a microphone to the mounting device.

In the illustrated embodiment of mounting device 1, the clamping section 3 is executed in two parts and comprises component sections 3*a* and 3*b*. The component sections 3*a* and 3*b* are arranged essentially in parallel and laterally a distance apart, and extend from the end sections of the connecting section 7 at right angle to its longitudinal direction. The component sections 3*a* and 3*b* are connected to each other by their adjacent ends, opposite of connecting section 7, by a bridge shaped end section 17, extending essentially in parallel to connecting section 7. The other clamping section 5, originating at connecting section 7, is located between the component sections 3*a* and 3*b* of the two-part clamping section 3. Clamping section 5 is short in comparison to clamping section 3, so that its end section 19 can not collide with the end section 17 of clamping section 3, which extends across.

To grip a section of a musical instrument between clamping sections 3 and 5, the end sections 17 and 19 of clamping sections 3 and 5 can be moved relative to each other, facilitated by the arrangement of clamping sections 3 and 5 on the connecting section 7 and the elasticity of the mounting device's material. If the two clamping sections are moved apart, a spring force, opposite to the direction of movement, is generated at each of the clamping sections 3 and 5. One direction of the spring force 13 and 15 is associated with each of the clamping sections 3 and 5. The two force directions 13 and 15 are directionally opposed and extend at right angles to the longitudinal extension of clamping sections 3 and 5, and to the longitudinal extension of end section 17.

Actuator sections 9*a*, 9*b*, and 11 are provided on the corresponding component sections 3*a* and 3*b*, near the connecting section 7, and on the clamping section 5. Further in the direction towards the end sections 17 and 19, on each of the component sections 3*a*, 3*b*, and on the clamping section 5, two stop lugs 21 and 23 are formed, containing flanks that rise steeply and end sloping down gently. The other lateral faces of clamping sections 3 and 5 are essentially flat, whereby the end sections 17 and 19 of clamping sections 3 and 5 are curved outward by an assigned amount, both against the corresponding force direction 13 and 15.

The actuator sections 9*a* and 9*b* of the component sections 3*a* and 3*b* extend outward in the direction of force 13 of clamping section 3. In the closed position of the mounting device 1, they extend over the essentially plane lateral face of the other clamping section 5, facing in the same direction as force 13 (compare FIG. 1). Conversely, the actuator section 11 of clamping section 5 extends in the force direction 15 of clamping section 5 and, in the closed position of mounting device 1, extends over the essentially plane lateral face of component sections 3*a* and 3*b* of clamping section 3, facing in force direction 15 (FIG. 1).

Aiding in the secure operation of the mounting device, several oblong outward cambers 27 are provided on the clamping sections 3 and 5, in the area of actuator sections 9*a*, 9*b*, and 11, essentially extending across the total width of clamping sections 3 and 5. The width of clamping sections 3 and 5 is slightly reduced on the corresponding opposing sides of clamping sections 5 and 3.

In the illustrated embodiment example the connecting section 7 is formed as one piece with clamping sections 3 and 5 and is of essentially cylindrical shape, which extends at right angles to clamping sections 3 and 5, and contains on its circumference several, essentially circumferential grooves 29, separated from each other by some distance. Hereby the cylinder axis in the illustrated embodiment example approximately coincides with the swivel axis of the two clamping sections 3 and 5.

The holding mechanism 25 is in the shape of a sleeve, with a slot along its longitudinal direction. At right angle to the longitudinal direction of the connecting section 7, the holding mechanism 25 is attached to a rotating section 31, which is shaped essentially cylindrical and joins the connecting section 7 with matching diameter on one side in its longitudinal direction. Relative to connecting section 7, rotating section 31 is supported rotatable around an axis 26, which extends on one side in longitudinal direction, centrally from the cylinder shaped connecting section 7. A bolt 32 with a wide bolt head is situated on the outer end of axis 26. The bolt's wide head prevents a slipping of rotating section 31, including the attached holding mechanism 25, off axle 26.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A mounting device for mounting a microphone or a microphone capsule to a musical instrument, said mounting device comprising:

first and second clamping sections in between which a section of a musical instrument can be gripped by spring force;

a connecting section that both of said first and second clamping sections are resiliently connected to by one of their ends;

a holding mechanism to mount the microphone or microphone capsule to said mounting device; and one actuator section on each of said first and second clamping sections;

wherein, in the unutilized condition of said mounting device, said actuator section on said first clamping section at least partially rises above said second clamping section in the direction of the spring force generated by said first and second clamping sections, when gripping a section of a musical instrument; and wherein at least said first clamping section comprises of at least two portions spaced laterally by a distance and originating from said connecting section, and said second clamping section is situated at least partially in between said portions of said first clamping section.

2. The mounting device of claim 1 wherein said portions of said first clamping section extend essentially in parallel and spaced from each other by some distance.

3. The mounting device of claim 1 wherein said actuator sections are placed in proximity to said connecting section.

4. The mounting device of claim 1 wherein one of said actuator sections is provided on each of said portions of said multi-portion clamping section.

5. The mounting device of claim 1 wherein said mounting device is formed as a single part.

6. The mounting device of claim 1 wherein said first clamping section comprises two portions, and said second clamping section, located essentially between said portions of said first clamping section, is formed as a single part.

7. The mounting device of claim 6 wherein the nonattached ends of said portions of said two-portion clamping section are connected to each other.

8. The mounting device of claim 1 wherein the nonattached end of said clamping sections is curved by a predetermined amount against the direction of the spring force created by said first and second clamping sections when gripping a portion of a musical instrument.

9. The mounting device of claim 1 wherein stop lugs are provided on those sides of said clamping sections that face a portion of an attached musical instrument.

10. A microphone comprising:

two first and second clamping sections in between which a section of a musical instrument can be gripped by spring force;

a connecting section that both said clamping sections are resiliently connected to by one of their ends;

a holding mechanism to mount the microphone or microphone capsule to said mounting device; and one actuator section on each of said first and second clamping sections;

wherein, in the unutilized condition of said mounting device, said actuator section on said first clamping section at least partially rises above said second clamping section in the direction of the spring force generated by said first and second clamping sections, when gripping a section of a musical instrument; and wherein at least said first clamping section comprises at least two portions spaced laterally by a distance and originating from said connecting section, and said second clamping section is situated at least partially in between said portions of said first clamping section.

11. The microphone of claim 10 wherein stop lugs are provided on those sides of said clamping sections that face a portion of an attached musical instrument.

12. The microphone of claim 10 wherein said portions of said first clamping section extend essentially in parallel and spaced from each other by some distance.

13. The microphone of claim 10 wherein said actuator sections are placed in proximity to said connection section.

14. The microphone of claim 10 wherein one of said actuator sections is provided on each of said portions of said multi-portion clamping section.

15. The microphone of claim 10 wherein said microphone is made as a single part.

16. The microphone of claim 10 wherein a first clamping section comprises of two portions, and clamping section, located essentially between said portions of said first clamping section, is formed as a single part.

17. The microphone of claim 16 wherein the nonattached ends of said portions of said two-portion clamping section are connected to each other.

18. The microphone of claim 10 wherein the nonattached end of said clamping sections is curved by a predetermined amount against the direction of the spring force created by said first and second clamping sections when gripping a portion of a musical instrument.

* * * * *